US010145654B2

(12) United States Patent
Thieffry

(10) Patent No.: US 10,145,654 B2
(45) Date of Patent: Dec. 4, 2018

(54) MOTOR DRIVEN AIMING DEVICE AND METHOD

(71) Applicant: SAFRAN ELECTRONICS & DEFENSE, Boulogne, Billancourt (FR)

(72) Inventor: Roland Thieffry, Boulogne Billancourt (FR)

(73) Assignee: SAFRAN ELECTRONICS & DEFENSE, Boulogne Billancourt (FR)

( * ) Notice: Subject to any disclaimer, the term of this patent is extended or adjusted under 35 U.S.C. 154(b) by 0 days.

(21) Appl. No.: 15/741,674

(22) PCT Filed: Jul. 1, 2016

(86) PCT No.: PCT/EP2016/065586
§ 371 (c)(1),
(2) Date: Jan. 3, 2018

(87) PCT Pub. No.: WO2017/005656
PCT Pub. Date: Jan. 12, 2017

(65) Prior Publication Data

US 2018/0195837 A1 Jul. 12, 2018

(30) Foreign Application Priority Data

Jul. 3, 2015 (FR) ..... 15 56304

(51) Int. Cl.

| | |
|---|---|
| ***F41G 5/06*** | (2006.01) |
| ***F41A 27/28*** | (2006.01) |
| ***F41G 5/16*** | (2006.01) |
| ***F41G 5/24*** | (2006.01) |

(52) U.S. Cl.
CPC ..... *F41G 5/06* (2013.01); *F41A 27/28* (2013.01); *F41G 5/16* (2013.01); *F41G 5/24* (2013.01)

(58) Field of Classification Search
CPC ..... F41G 5/06; F41G 5/00; F41G 5/14; F41G 5/16; F41G 5/26; F41A 27/28
See application file for complete search history.

(56) References Cited

U.S. PATENT DOCUMENTS 3,405,599 A * 10/1968 Brandstadter ..... F41G 5/14 89/41.09
4,480,524 A * 11/1984 Blomqvist ..... F41G 3/00 89/41.16
5,413,028 A * 5/1995 Ng ..... F41G 3/323 89/37.08

(Continued)

FOREIGN PATENT DOCUMENTS

DE 10 2013 006939 A1 10/2014
FR 2 821 928 A1 9/2002

*Primary Examiner* — Benjamin P Lee
(74) *Attorney, Agent, or Firm* — Muncy, Geissler, Olds & Lowe, PC

(57) ABSTRACT

A method of controlling a motor-driven aiming device, the method including the steps of servo-controlling the motor as a function of a difference between a nominal speed setpoint and a measurement of the angular speed sensor, and in the event of saturation, determining a correction value for correcting the nominal speed setpoint as a function of a difference between a reference inertial position prior to the saturation and a current inertial position, and applying the correction value to the nominal speed setpoint. An aiming device for implementing the method.

4 Claims, 1 Drawing Sheet

(56) References Cited

U.S. PATENT DOCUMENTS

| | | | | |
|---|---|---|---|---|
| 5,520,085 | A * | 5/1996 | Ng | F41G 3/323 89/14.05 |
| 6,497,171 | B2 * | 12/2002 | Gerber | F41A 27/28 89/41.02 |
| 9,593,913 | B1 * | 3/2017 | Wright | F41A 23/56 |
| 2001/0039874 | A1 | 11/2001 | Gerber et al. | |
| 2002/0074486 | A1 | 6/2002 | Gerber et al. | |

* cited by examiner

MOTOR DRIVEN AIMING DEVICE AND METHOD

The present invention relates to motor-driven aiming or steering of an element in a predetermined direction, and in particular to aligning a weapon on a line of sight.

STATE OF THE ART

It is known to mount an aiming device comprising a stationary structure and a steerable support on a weapon system that is steerable relative to a reference frame such as that of the vehicle carrying the weapon system if it is a motor-driven weapon system. The support of the aiming device is mounted on the structure of the weapon to be steerable about two axes of rotation, namely an elevation axis and a bearing axis, by means of two electric motors.

The motors are controlled so as to bring the steerable support into alignment on a direction corresponding to the line of sight determined by the sight setter of the weapon and so as to maintain the alignment.

When firing, the recoil of the weapon produces an impact that causes the support to turn suddenly. The motors are controlled to oppose this sudden turning until the control of the motors becomes saturated, thereby limiting the risk of damaging the electronics of the device, but making it impossible to maintain the alignment of the support on the line of sight. There then arises an offset between the real angular position of the support and the line of sight. The control of the motors does not enable the motors to take up this offset quickly, such that in the event of a burst of fire, there is a risk that the second shot and the subsequent shots will be further and further away from the target.

OBJECT OF THE INVENTION

An object of the invention is to provide means making it possible to improve the accuracy with which a motorized support is aligned in the event of an impact or any other physical phenomenon that leads to the motor becoming saturated.

BRIEF SUMMARY OF THE INVENTION

To this end, the invention provides a method of controlling an aiming device comprising a stationary structure having mounted thereon a support so as to be steerable about at least one axis of rotation by means of at least one motor, the support being provided with at least one inertial sensor of angular speed about that axis, the method comprising the steps of:

- servo-controlling the motor as a function of a difference between a nominal speed setpoint and a measurement of the angular speed sensor; and
- determining a correction value for correcting the nominal speed setpoint as a function of a difference between a reference inertial position and a current inertial position, and applying the correction value to the nominal speed setpoint.

In the event of the motor saturating, the reference inertial position is the position in which the support was to be found immediately prior to the motor saturating. This position is measured by the inertial sensor of angular speed. With the invention, the nominal speed setpoint is increased so as to bring the support quickly towards the reference inertial position.

The invention also provides an aiming device comprising a stationary structure having mounted thereon a support to be steerable about at least one axis of rotation by means of at least one motor connected to a control unit. The support is provided with at least one inertial sensor of angular speed about that axis, the control unit being arranged:

- to servo-control the control of the motor as a function of a difference between a nominal speed setpoint and a measurement of the angular speed sensor; and
- in the event of saturation being detected, to determine a correction value for correcting the nominal speed setpoint as a function of a difference between a reference inertial position and a current inertial position, and applying the correction value to the nominal speed setpoint.

Other characteristics and advantages of the invention appear on reading the following description of particular, non-limiting embodiments of the invention.

BRIEF DESCRIPTION OF THE FIGURES

Reference is made to the accompanying drawing, in which.

DETAILED DESCRIPTION OF THE INVENTION

Figure 1:
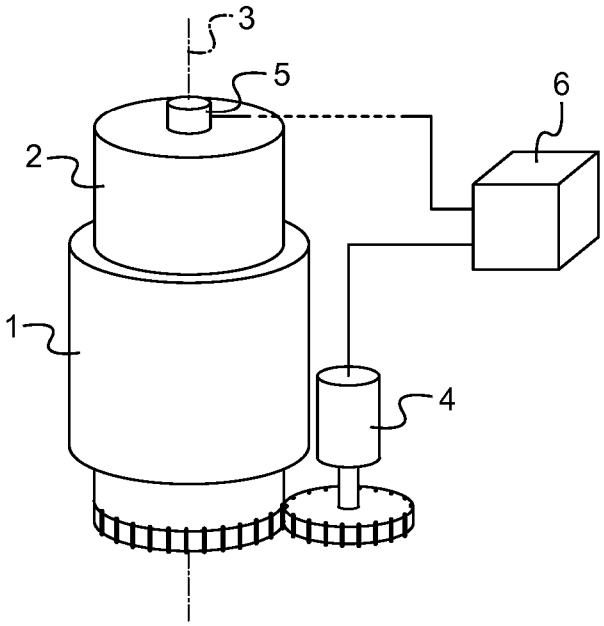
FIG. 1 is a diagrammatic view of an aiming device in accordance with the invention.

With reference to FIG. 1, the aiming device of the invention comprises a stationary structure 1 in which there is mounted a support 2 to pivot about an axis 3, which is vertical in this example. The structure 1 is arranged to be secured on a carrier, e.g. a vehicle or a tank turret. The support 2 is arranged to carry the element that is to be aimed, a weapon or an aiming device, for example, and it is connected to the structure 1 by rolling bearings coaxial about the axis 3.

The angular position of the support 2 is adjustable about the axis 3 by means of an electric motor 4 having an outlet shaft connected via motion transmission means to a ring that is coaxial about the axis 3 and that is secured to the support 2. The motion transmission means may for example be gears, a belt, cables, . . . . The motor may also be mounted to be directly engaged with the element that is to be driven, thereby connecting the structure 1 to the support 2.

The support 2 is also fitted with an inertial sensor for sensing angular speeds about the axis 3, namely a gyro 5.

The electric motor 4 and the gyro 5 are connected to a computer control unit 6 arranged to run a control program and including an interface enabling an operator of the aiming device to input data into the control program. The computer control unit 6 continuously stores the angular speed measured by the gyro 5.

Figure 2:
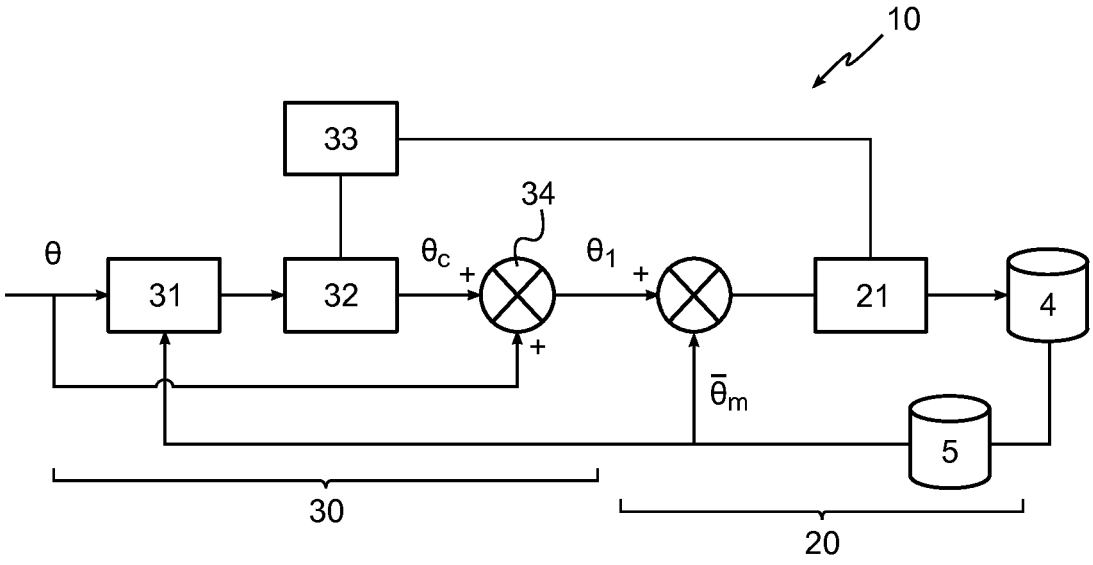
FIG. 2 is a view showing diagrammatically how the motor of the aiming device is controlled.

The operation of the control program is illustrated in FIG. 2 in the form of a control system given overall reference 10 and arranged to control the electric motor 4 as a function of a nominal speed setpoint $\dot{\theta}$ calculated from data input by the operator of the aiming device.

The control system comprises a main control loop 20 and a correction loop 30 that intervenes in the event of the electric motor 4 becoming saturated.

The main control loop 20 comprises a control element 21 for controlling motors that determines the control parameters for the electric motor 4 as a function of a difference between a speed setpoint $\dot{\theta}_1$ and a speed of the support 2, written $\dot{\theta}_M$. The speed $\dot{\theta}_M$ is measured by the gyro 5.

The correction loop 30 comprises an estimator 31 for estimating the difference between a reference inertial position prior to saturation and a current inertial position, and a corrector 32 that is arranged to correct the nominal speed setpoint $\dot{\theta}$ as a function of the difference. This correction is a correction of the proportional integral type that supplies a corrected speed setpoint $\dot{\theta}_c$. The correction loop 30 also has a detector 33 for detecting saturation of the electric motor 4 on the basis of saturation information coming from the control element 21. The detector 33 serves to monitor the occurrence of saturation of the electric motor 4 and it is arranged to activate the correction loop 30 in the event of the electric motor 4 saturating. A summing circuit 34 adds the nominal speed setpoint $\dot{\theta}$ and the corrected speed setpoint $\dot{\theta}_c$ in order to obtain the speed setpoint $\dot{\theta}_1$.

Thus, in normal operation, when saturation does not occur, the speed setpoint $\dot{\theta}_1$ is equal to the nominal speed setpoint $\dot{\theta}$.

In contrast, in the event of said saturation, the correction loop 30 is activated by the detector 33 so that the nominal speed setpoint $\dot{\theta}$ is corrected by the corrector 32, which supplies the corrected speed setpoint $\dot{\theta}_c$.

Naturally, the invention is not limited to the embodiments described but encompasses any variant coming within the ambit of the invention as defined by the claims.

In particular, the support 2 may be mounted in the structure 1 so as to be adjustable in position about two mutually perpendicular axes, for example. The support 2 may be mounted in the structure 1 to be adjustable in elevation and in bearing relative to the structure 1 by means of two motors using either an inertial angle sensor having two sensing axes or else two inertial angle sensors each having one sensing axis.

The invention is applicable to any aiming device that is arranged to steer any element in a predetermined direction.

The support may be fitted with a plurality of inertial sensors: a first sensor used for the conventional stabilization control loop, and a gyro for the correction loop.

It is possible either to use an absolute reference position value, as mentioned above, or else to use the current absolute position error as calculated at each iteration of the control.

The method may be implemented continuously by adding an outer absolute (or inertial) position loop. The device for implementing the method then does not have elements for triggering and stopping the function 33; there is no reference measurement made by the estimator and the speed setpoint supplied by the operator is always corrected by the speed setpoint from the corrector 32. This implementation serves to reduce considerably the impact of friction and also to increase performance in terms of stabilizing oscillations of the servo-controlled system. The method can thus also be used as a friction compensator.

The invention claimed is:

1. A method of controlling an aiming device comprising a stationary structure having mounted thereon a support so as to be steerable about at least one axis of rotation by means of at least one motor, the support being provided with at least one inertial sensor of angular speed about the at least one axis, the method comprising the steps of:

servo-controlling the at least one motor as a function of a difference between a nominal speed setpoint and a measurement of the angular speed sensor, and monitoring for the at least one motor becoming saturated; and in the event of saturation being detected, determining a correction value for correcting the nominal speed setpoint as a function of a difference between a reference inertial position prior to the saturation and a current inertial position, and applying the correction value to the nominal speed setpoint.

2. The method according to claim 1, wherein the correction value is obtained by a correction of the proportional integral correction type.

3. An aiming device comprising a stationary structure having mounted thereon a support to be steerable about at least one axis of rotation by means of at least one motor connected to a control unit, the device being characterized in that the support is provided with at least one inertial sensor of angular speed about the at least one axis, and in that the control unit is arranged:

to servo-control the at least one motor as a function of a difference between a nominal speed setpoint and a measurement of the angular speed sensor, and monitoring for the at least one motor becoming saturated; and in the event of saturation being detected, to determine a correction value for correcting the nominal speed setpoint as a function of a difference between a reference inertial position prior to the saturation and a current inertial position, and applying the correction value to the nominal speed setpoint.

4. The device according to claim 3, wherein the correction value is obtained via a correction of the proportional integral correction type.

* * * * *